United States Patent [19]

Luebbers

[11] 4,218,976

[45] Aug. 26, 1980

[54] PRACTICE PROJECTILE FOR MORTARS AND THE LIKE

[75] Inventor: Willi Luebbers, Trittau, Fed. Rep. of Germany

[73] Assignee: Nico-Pyrotechnik Hanns-Juergen Diederichs KG., Trittau, Fed. Rep. of Germany

[21] Appl. No.: 915,604

[22] Filed: Jun. 15, 1978

[30] Foreign Application Priority Data

Jun. 15, 1977 [DE] Fed. Rep. of Germany ..... 2726945

[51] Int. Cl.[2] ..... F42B 5/10

[52] U.S. Cl. ..... 102/49.1; 102/49.4; 102/66; 102/92.7

[58] Field of Search ..... 102/7.6, 41, 92.7, 60, 102/66, 87, 90, 34.4, 35.6, 37.6, 49.4, 49.1, 49.2

[56] References Cited

U.S. PATENT DOCUMENTS

| | | | |
|---|---|---|---|
| 1,632,147 | 6/1927 | Ragsdale | 102/7.6 |
| 3,101,053 | 8/1963 | Stevenson et al. | 102/66 |
| 4,109,579 | 8/1978 | Carter | 102/41 |

FOREIGN PATENT DOCUMENTS

| | | | |
|---|---|---|---|
| 216641 | 8/1957 | Australia | 102/7.6 |
| 712390 | 7/1931 | France | 102/90 |

*Primary Examiner*—Harold J. Tudor

[57] ABSTRACT

A practice projectile for mortars and the like which has a nose fuse mounted on a shell casing. A pyrotechnic charge is disposed in the shell casing. A tail section is mounted in the rear of the shell casing and holds a propellant charge. A percussion cap is mounted in the nose of the projectile and is adapted to be ignited by the nose fuse. A central pipe, having one end opposite the percussion cap, extends from the proximity of the percussion cap to the proximity of the propellant charge in the tail section. The flame from the percussion cap travels through the central pipe and ignites the propellant charge which causes the tail section to be expelled from the rear of the shell casing to thereby expose a rear opening in the shell casing through which the pyrotechnic gases produced by the also ignited pyrotechnic charge are expelled.

6 Claims, 1 Drawing Figure

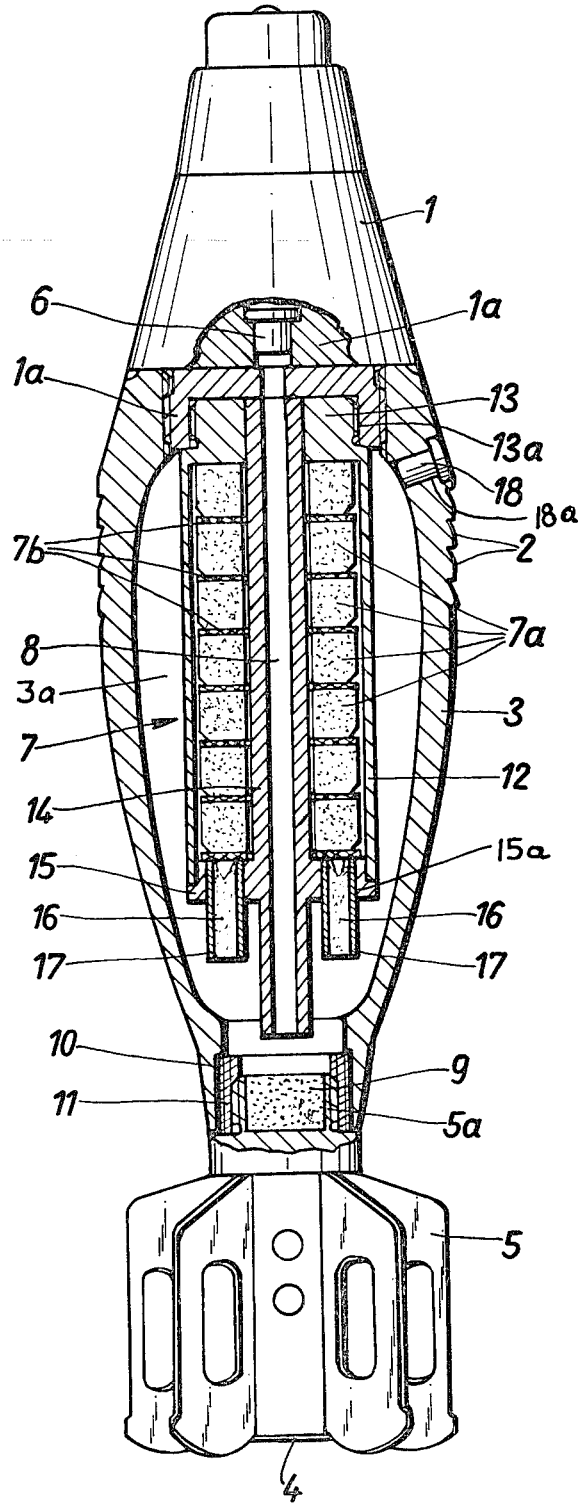
1
6
1a
1a
13
13a
18
18a
2
7b
7a
8
3a
3
7
12
14
15a
15
16
16
17
17
10
9
11
5a
5
4

PRACTICE PROJECTILE FOR MORTARS AND THE LIKE

BACKGROUND OF THE INVENTION

The present invention relates to a practice or dummy shell or projectile for mortars and the like. The projectile includes a nose fuse, a pyrotechnic charge disposed in the shell casing of the projectile as well as a propellant charge arranged in the tail section of the projectile.

Practice or dummy shells or projectiles of the afore described type having a slight rifling are already known in the art and are, for example, described in German patent number DT-PS 1063065. The projectile body of this known projectile is transversely cut off and the tail section of the projectile is provided with a tail tube housing having guide fins, the diameter of which is substantially smaller than that of the projectile body. This tail tube housing is mounted in the main body of the projectile by being inserted in the rear portion thereof.

A pyrotechnic charge can either be disposed in the front section of the tail tube or even in front of the same in a recess of the projectile body itself. Immediately upon impact of the projectile, the pyrotechnic charge is ignited and the ensuing gas formation is forced through the long tail tube thereby expelling the rear closure plug. The marker charge which may contain smoke, flare or signal producing means becomes thereby visible.

In view of the fact that this known projectile operates as a supersonic projectile makes it very doubtful whether the long tail tube as well as the plug which is acted on by the propellant charge remain intact upon impact. In the event that the aforegoing elements of the projectile do not remain intact the visual effect of the marking charge is non-existent or ineffectual.

There is, furthermore, known another type of practice or dummy projectile which is described in German patent DT-PS 1024405. In this known practice or dummy projectile a smoke charge is mounted in the shell casing which connects with a built-in striker pin in such a way that, upon impact of the projectile, the smoke charge is ignited and the smoke is expelled through a number of openings in the shell casing. The construction of this known practice projectile having ignition and ignition transmission means is not only expensive and constructionally complex but, in the event of an ignition malfunction, has the pronouced drawback that the ignition means cannot be disassembled from the smoke charge. Consequently, the malfunctioning ignition means renders an otherwise intact smoke charge completely useless. Moreover, this known practice or dummy projectile has the additional drawback that, in the event of a sharp impact angle of the projectile one or more of the smoke omitting openings are blocked by the ground surface which considerably inhibits the visual marking effect of the projectile.

This type of projectile also represents the equivalent of an unexploded bomb having a live percussion cap and a relatively large explosive charge and has the ever-present serious danger to life and limb to anybody coming in contact with this type of projectile.

SUMMARY OF THE INVENTION

The invention has as its general object to provide a dummy or practice projectile for mortars having a pyrotechnic charge in which the afore described drawbacks of the projectiles of the state-of-the-art are minimized.

It is a further object of this invention to provide a simple and inexpensive practice or dummy projectile which has precisely defined ballistic characteristics and does not include any parts which might endanger life and limb when the projectile is contacted in its unexploded condition.

It is another object of this invention to provide a projectile of the afore described type which has a nose fuse which can be easily disassembled and replaced by a new nose fuse.

The object of the invention is achieved by means of providing a percussion cap, which on impact is activated by a fuse. This fuse is disposed opposite a central firing channel which is surrounded by a pyrotechnic charge. The shell casing has an extension into which the tail section of the projectile extends and in which there is disposed a propellant and heating charge which is ignitable by the percussion cap. This propellant charge, when ignited, causes the tail section to be expelled and to expose a rear opening in the projectile and also causes the ignition of the pyrotechnic charge.

According to another feature of this invention a delayed charge is disposed in the ignition chain between the propellant charge and the pyrotechnic charge. In this projectile the pyrotechnic charge can be encased on the outside by a cylindrical housing and on the inside by a pipe forming the central ignition channel and can be enclosed on both sides by endwalls, one of which faces the propellant charge and is connected to the central pipe and is provided with a plurality of bores for receiving a delay charge. The other endwall, which faces the nose fuse and is connected to the cylindrical housing, has an external thread on to which the fuse body can be screwed on.

Another feature of the invention resides in that a sleeve made of thermoplastic material, which is meltable by the fired propellant charge, is arranged in the rear opening of the projectile and is adapted to receive the connecting piece of the tail section.

A last feature of the invention resides in the disposition of the safety plug which is disposed in the shell casing of the projectile and is expelled outwardly in case excess pressure builds up within the projectile.

BRIEF DESCRIPTION OF THE DRAWING

The invention is further set forth in the following detailed description taken in conjunction with the appended drawing, in which:

The sole FIGURE of the drawing illustrates, partially in cross section, a side elevational view of a projectile in accordance with this invention.

DETAILED DESCRIPTION

There is depicted in the single FIGURE of the drawing one practical example of the practice or dummy projectile which essentially includes a nose fuse 1, a shell casing 3 having guide wings or rifling 2.

The shell casing 3 is provided with a tail section 5 in which a propellant charge 4 is disposed. The nose fuse 1 has a lower portion 1a having a central bore in which a percussion cap 6 is mounted. This percussion cap 6 is mounted oppositely from a central ignition channel 8 disposed in a centrally mounted pipe 14. The central pipe 14 is surrounded by a smoke charge 7. Furthermore, a propellant charge 9 is mounted in the tail section pipe extension 5a of the tail section 5. The propellant charge 9 is ignited by means of the flame emanating from the percussion cap 6 which travels through firing channel 8 and impacts on the propellant charge 9. The shell casing 3 has in its rear portion a rear opening 10 which is not clearly illustrated because of the tail section 5 being depicted as mounted therein. In order to make apparent its construction, it has been illustrated in the sole FIGURE by means of special cross hatching. As can be noted from the drawing there is mounted a special sleeve 11 in the rear opening 10. This sleeve 11 is made of a thermoplastic meltable material. The smoke charge 7 is composed of a stack of ring tablets or pellets 7a coaxially arranged in the chamber 3a of the shell casing 3 through the central openings of which the central pipe 14 extends. Each one of the ring tablets 7a is separated from the adjacent ring tablet by means of rings of primer charges 7b. This entire arrangement is disposed within a thin-walled cylindrical housing 12 having an integral endwall 13. The pipe 14 defines an ignition duct 8 which is axially mounted within the cylindrical housing 12. A second endwall 15, integral with the central pipe 14 body, forms a closure for the cylindrical housing 12. The other endwall 13 is provided with an external thread 13a for purposes of threadably mounting the cylindrical housing 12 into the externally threaded connecting member 1a of the nose fuse 1. Thus, as can be noted from the drawing, the endwall 15 is provided with a plurality of openings 15a into which are mounted the pipe pieces 17 which hold delay charges 16.

The smoke charge 7 is composed of a plurality of annular pellets 7a and rings of a primer charge 7b which are arranged in juxtaposed position over the central pipe 14 in the cylindrical housing 12. The pipe 14 extends rearwardly in proximity to the propellant charge 9.

When the projectile of this invention impacts upon a target, the ignition capsule of fuse 1 (not illustrated) transfers an ignition function to the percussion cap 6 which produces an ignition flame that travels through the ignition duct or firing channel 8 and strikes the propellant charge 9. This in turn causes a progressive burning of the propellant charge 9 which produces an ignition of the delay charges 16, which in turn produces, after a certain time delay, the ignition of the primer charge rings 7b and eventually the ring pellets 7a of the smoke charge 7. In the meantime the burn off of the propellant charge 9 is progressing to such an extent that the thermoplastic sleeve 11 melts. Also, a slight pressure is building up in the chamber 3a of the shell casing 3 due to the gas formation caused by the burning of the annular pellets 7a and the primer charge rings 7b. This causes an expulsion of the entire tail section 5 which now exposes the entire rear opening 10. The smoke gases can now escape through this comparably large opening 10 through the rear of the projectile which makes for an excellent visual effect.

As can be noted from the drawing, the shell casing 3 is provided with a safety plug 18 mounted in an opening 18a of the shell casing.

In view of the fact that, after impact of the projectile in the target area, the tail section 5 is still connected to the projectile, the opening 10 remains freely accessible even after the tail section 5 has been expelled, so that the free discharge of the smoke gases enables the visual marking effect to become fully effective. If, for reasons of some type of malfunction, the tail section 5 is not expelled so that the opening 10 remains blocked, the safety plug 18, after a certain level of internal pressure has been reached in the chamber 3a, is expelled outwardly so that smoke may exit and be expelled through the opening 18a of the shell casing.

In view of the fact that the practice projectile does not contain any true explosive charges, but only weak primer charges, the unexploded projectile does not pose a serious danger even for children handling the practice projectile.

It is to be understood that the projectile of this invention is not strictly limited to the afore described example and that, of course, variations of the projectile are considered to be within the scope of the invention. For example, it is possible to use instead of the smoke charges also artificial fog or signal charges, which can also be considered to belong to the general group of pyrotechnic charges. In the latter cases it is advantageous to dispose these charges in the housing 12 in a dense arrangement where they are closely disposed adjacent to each other so that they form a good ignition or firing duct or channel 8 without a pipe 14.

Although the invention is illustrated and described with reference to one type of practice shell or projectile, it is to be understood that it is in no way limited to the disclosure of such one embodiment, but is capable of numerous modifications within the scope of the appended claims.

What I claim is:

1. A practice projectile for mortars and the like, comprising in combination, a longitudinal casing, having a front end and a rear end having an axially extending rear passage;

nose fuse means operatively mounted on the front end of said casing;

a tail section removably mounted in said rear passage;

a percussion cap operatively mounted in said casing and being adapted to be ignited by said nose fuse means upon impact of said projectile;

a firing duct mounted in said casing and axially extending from proximity of said front end to proximity of said rear end;

a propellant charge mounted in said tail section; a pyrotechnic charge surrounding said firing duct in said shell casing;

delay charge means mounted in said casing forming a link in the ignition chain between said percussion cap and said pyrotechnic charge; and a cylindrical housing coaxially mounted in said shell casing, said pyrotechnic charge being disposed in said cylindrical housing, said cylindrical housing having end wall means at its opposite ends and said firing duct axially extending through said cylindrical housing and said end wall means;

whereby upon impact of the projectile the nose fuse means is adapted to activate an ignition chain causing the percussion cap to emit an ignition flame that travels through said firing duct to first ignite said propellant charge in said tail section to thereafter cause an expulsion of said tail section from said rear passage of the rear end of the casing and the ignition of said pyrotechnic charge and formation of pyrotechnic gases so that these pyrotechnic gases may exit from said rear passage.

2. The practice projectile as set forth in claim 1, wherein said firing duct is formed at least partially by a pipe axially mounted in said cylindrical housing.

3. The practice projectile as set forth in claim 2, wherein said endwall means facing said propellant charge in said tail section has at least one passage in which a delay charge is mounted.

4. The practic projectile as set forth in claim 1, wherein said endwall means facing said nose fuse means is provided with an external thread and the front end of said casing is provided with a mating internal thread so that said cylindrical housing can be threadably mounted in said front end of said casing.

5. The practice projectile as set forth in claim 1, a sleeve of thermoplastic meltable material coaxially mounted in said rear passage and adapted to receive at least a portion of said tail section, whereby upon ignition of said propellant charge said sleeve melts and permits the expulsion of said tail section from said rear passage.

6. The practice projectile as set forth in claim 1, wherein said casing has at least one safety passage in addition to said rear passage, and a safety plug operatively mounted in said safety passage, said plug being adapted to be forcibly expelled from said safety passage when excess pressure builds up in said casing.

* * * * *